US011629558B2

(12) United States Patent
Linder et al.

(10) Patent No.: US 11,629,558 B2
(45) Date of Patent: Apr. 18, 2023

(54) MELTING HEAD FOR ICE-MELTING APPARATUS

(71) Applicant: RHEINISCH-WESTFÄLISCHE TECHNISCHE HOCHSCHULE (RWTH) AACHEN, Aachen (DE)

(72) Inventors: Peter Linder, Juelich (DE); Simon Zierke, Aachen (DE); Dirk Heinen, Aachen (DE); Christoph Wiebusch, Aachen (DE)

(73) Assignee: RHEINISCH-WESTFAELISCHE-TECHNISCHE HOCHSCHULE AACHEN, Aachen (DE)

( * ) Notice: Subject to any disclaimer, the term of this patent is extended or adjusted under 35 U.S.C. 154(b) by 0 days.

(21) Appl. No.: 16/978,685

(22) PCT Filed: Apr. 25, 2019

(86) PCT No.: PCT/EP2019/060615

§ 371 (c)(1),
(2) Date: Sep. 5, 2020

(87) PCT Pub. No.: WO2019/207045

PCT Pub. Date: Oct. 31, 2019

(65) Prior Publication Data

US 2021/0071478 A1 Mar. 11, 2021

(30) Foreign Application Priority Data

Apr. 25, 2018 (DE) ..... 102018003378.4

(51) Int. Cl.
*E21B 7/15* (2006.01)
*H05B 3/42* (2006.01)

(52) U.S. Cl.
CPC . *E21B 7/15* (2013.01); *H05B 3/42* (2013.01)

(58) Field of Classification Search
CPC ..... E21B 7/008; E21B 7/14; E21B 7/15
See application file for complete search history.

(56) References Cited

U.S. PATENT DOCUMENTS 3,468,387 A * 9/1969 Benson ..... E21B 7/15 175/16
3,680,645 A * 8/1972 Horbach ..... E21B 7/15 175/16

(Continued)

FOREIGN PATENT DOCUMENTS

CN 102839918 A 12/2012
DE 10164648 C1 2/2003

(Continued)

OTHER PUBLICATIONS

Theory of Performance of Isothermal Solid-Nose Hotpoints Boring in Temperate Ice, R.L.Shreve, Department of Geology and Institute of Geophysics, University of Califirnia, Los Angeles, Calif.

(Continued)

*Primary Examiner* — David Carroll
(74) *Attorney, Agent, or Firm* — Andrew Wilford

(57) ABSTRACT

The invention relates to a melting head (1) for an ice melting apparatus (1, 8) comprising a rear, in relation to the propagation direction, attachment region (4) for attaching to a drilling apparatus (8) or a drilling rod assembly, and a forward, in relation to the propagation direction, heatable front region (1*c*), wherein the front region (1*c*) has a radially outer face region (1*a*) in which the front region (1*c*) has an outer cross section that tapers in the propagation direction (3) up to the forward axial melting head end (1*d*), in particular with a tapering outer diameter, and the radially outer face region (1*a*) surrounds an inner cavity (5), the free inner cross section of which reduces from the axial melting head end (1*d*) counter to the propagation direction (3). The (Continued)

invention also relates to an ice melting apparatus (1, 8) formed with the melting head (1).

10 Claims, 4 Drawing Sheets

(56) References Cited

U.S. PATENT DOCUMENTS

| | | | | |
|---|---|---|---|---|
| 3,759,046 | A * | 9/1973 | Anders | E02B 17/0021 405/211 |
| 3,991,817 | A * | 11/1976 | Clay | E21B 21/12 165/45 |
| 6,343,652 | B1 | 2/2002 | Corre et al. | |
| 2007/0127896 | A1 | 6/2007 | Dunker | |

FOREIGN PATENT DOCUMENTS

| | | | |
|---|---|---|---|
| GB | 1315921 | A | 5/1973 |
| GB | 1575151 | B | 9/1980 |
| RU | 1149670 | A1 | 12/1995 |
| SU | 1023054 | A1 | 6/1983 |
| SU | 1087648 | A1 | 4/1984 |

OTHER PUBLICATIONS

A Thermal Ice-Melt Probe for Exploration of Earth-Analogs to Mars, Europa and Enceladus, D.P.Winebrenner, W.T. Elam, V.Miller, and M.Carpenter, Applied Physics Laboratory, University of Washington, Seattle, WA 98185 USA, dpw@apl.washington.edu: Dept. of Earth and Space Sciences, University of Washington, Seattle, WA 98195 USA.

Optimization of the Heating Surface Shape in the Contact Melting Problem, Sergei A. Fomin, Dept. of Applied mathematics, Kazan State University, Kazan, 420008, USSR, and Shangmo Cheng, Dept. of Power Engineering, Huazhong University of Science and Technology, Wuhan, 430074, China.

Melting Probes Revisited—Ice Penetration Experiments Under Mars Surface Pressure Conditions, Norbert I. Koemle et al, Icarus, www.elsevier.com/locate/icarus.

* cited by examiner $$y(r) = \begin{cases} r \le \frac{R}{\sqrt{2}}; & \overset{P}{-2h\frac{r^2}{R^2}} \\ r > \frac{R}{\sqrt{2}}; & \underset{I}{-1}\Big(\underbrace{-2h\frac{r^2}{R^2}}_{P} \underset{O}{-2h}\Big) \end{cases}$$

MELTING HEAD FOR ICE-MELTING APPARATUS

CROSS REFERENCE TO RELATED APPLICATIONS

This application is the US-national stage of PCT application PCT/EP2019/060615 filed 25 Apr. 2019 and claiming the priority of German patent application 102018003378.4 itself filed 25 Apr. 2018.

FIELD OF THE INVENTION

The invention relates to a melting head of an ice-melting apparatus.

BACKGROUND OF THE INVENTION

Such an apparatus has, with respect to its travel direction, a rear attachment end for attaching to a drilling string or a drilling rod assembly and, with respect to the travel direction, a heatable front end. An established connection of such a melting head and the drilling string or a drilling rod assembly can then preferably form an ice-melting apparatus.

The travel direction is to be understood as the direction in which the melting head or an ice-melting apparatus formed therewith moves in the ice and melts it when used as intended. The travel direction is preferably coincident with a central axis, in particular a central longitudinal axis, of the melting head and/or an ice-melting apparatus formed therewith.

Melting heads of this type are generally known from the prior art and are used to drill holes in ice, in particular by melting the ice surrounding the melting head with the heated front end of the melting head and the melting head together with the drilling string or drilling rod assembly connected thereto as it penetrates into the depth in the direction of gravity by the weight force acting thereon. If necessary, an additional driving force can also be exerted by a drilling rod assembly.

The prior art and also the invention further described herein can provide that heating elements within the melting head are supplied with energy provided by the drilling string or the drilling rod assembly.

For example, it can be provided that a drilling string forms a cylindrical casing at whose front end as seen in the travel direction the melting head with its rear attachment end is attached. The melting head preferably has a maximum outer cross-section, in particular diameter, that corresponds to the cross-section, in particular diameter, of the cylindrical drilling string. Inside the drilling string, for example an energy source, if necessary also further electronics can be carried along, in particular also, for example a unwindable cable supply in order to provide a communication possibility and/or energy transmission via the cable between the drilling string and the surface above ground.

A possible field of application is the drilling of drill holes in water-ice, for example in glaciers or also arctic regions of the earth. An application is also given for the drilling of drill holes into the ice surface of astronomical bodies distant from the earth (for example planets, moons, comets etc.). It should in particular be noted that the term "ice" is not limited to water-ice. Ice in the context of the invention is also understood to be any other substance that is present in the solid state and can be converted into another state of aggregation, in particular into the liquid state or even gaseous state, by means of the heat of the melting drilling head.

Melting heads of melting drilling strings, as mentioned above, have heating elements with which heat is generated, for example by resistance heating, which heat is transported by conduction between the heating element and the material of the melting head at the outer surface thereof to cause the melting process there.

Heat transport usually takes place not only outward from the typically several heating elements to the surface of the front end of the melting head heated therewith, but also to the inside of the melting head and the entire drilling string, which can lead to problems.

For example, heat build-up can occur inside, which can harm the electronics or energy storage devices carried along. Furthermore, the heat emitted to the interior is effectively not available or only with reduced efficiency for heating the front of the melting head and can get lost via the rear end of the melting head or the drilling string without having contributed to the progress of the heat drilling.

OBJECT OF THE INVENTION

It is therefore an object of the invention to provide an improved melting head that makes it possible to overcome the disadvantages mentioned, in particular to make better use of the heat emitted by heating elements in the melting head to the outside and to the inside.

SUMMARY OF THE INVENTION

This object is attained according to the invention in that the front end of the melting head has a radially outer surface that tapers in the travel direction up to the front axial end of the melting head, is in particular of decreasing outer diameter, and the radially outer surface surrounds an inner cavity, in particular an inner cavity open forward in the travel direction, the free inner cross-section of which decreases in size from the axial end of the melting head rearward against the travel direction. The plane in which the axially front edge of the melting head is located preferably also forms the plane of the opening of the inner cavity. Preferably, a normal vector to this (opening) plane is parallel to the travel direction.

The outer and inner cross-sections named here are to be understood as viewed perpendicular to the travel direction.

With this configuration according to the invention the heated front end has both a heated radially outwardly directed surface and a heated radially inwardly directed surface, namely the inner wall surface of the cavity.

In particular, the radial direction is understood to be perpendicular to the travel direction or central longitudinal axis of the melting head. Located radially on the inside and on the outside in conjunction with the surfaces mentioned above means that the inner surface has a smaller radial spacing from the center axis than the outer surface.

Both the inner and the outer surfaces of the front end are not parallel to the travel direction or are inclined to the travel direction due to the respective tapers in or counter to the axial direction, so that the movement of the melting head in the travel direction results in an effective application of force to the surrounding ice by means of these surfaces.

When viewing a projection of these surfaces parallel to the travel direction or the center axis of the melting head, these inclinations of the inner and outer surfaces result in respective projection surfaces that are thus perpendicular to the propagation and are acted upon by the ice.

The inner projection surface in fact corresponds to the inner free cross-section of the inner cavity in the plane of the front axial melting-head edge. The outer projection surface forms a ring surrounding the inner projection surface, whose outer cross-section, in particular outer diameter, corresponds to the maximum outer cross-section of the melting head and preferably of the entire drilling string.

The amount of heat conducted through from the heating elements to the outside and to the inside can thus be dissipated much better to the environment, namely, according to the invention, via the front end of the melting head, which contributes to an improved drilling progress and prevents an internal heat accumulation.

Due to the embodiment described, the front axial melting-head edge forms a border, in particular a ring, via which the radially outer surface and the surface of the inner cavity merge into each other. The end surface of this ring pointing in the travel direction can be formed for example sharp-edged or crowned (or rounded) or flattened.

Due to the increase in external cross-section of the radially outer surface starting from the front melting-head edge counter to the travel direction and the reduction in internal cross-section of the cavity counter to the travel direction, the result is that the front end of the melting head forms a axially directed annulus whose width, thus the difference from external to internal cross-section, increases from the front axial melting-head edge counter the travel direction, in particular up to the axial position of the floor of the inner cavity.

It represents a particularly preferred embodiment of the invention if the heating elements are arrayed, at least in sections, in particular at least with their heat-emitting tip regions, in the material of the front end of the melting head that is between the tapered outer surface and the inner surface of the inner cavity, thus de facto embedded in the material of the mentioned annulus of the front end. This ensures particularly well that the heat emitted by the heating elements can be dissipated both via the tapered outer surface and the inner surface of the cavity by a particularly short, in particular almost radial, transport to the surroundings and contributes to the melting process.

Particularly preferably, the melting head can comprise a plurality of heating elements, in particular fitted in respective holes of the melting head that are rearwardly open in particular counter to the travel direction, each of the heating elements and/or holes having a radial spacing from the center axis of the melting head that corresponds at least substantially to the radial spacing of the border- or ring-shaped axially front melting-head edge, and corresponds in particular to the radial spacing of the melting-head edge. Thus the transport path to the inner surface and the transport path to the outer surface are at least substantially the same length.

In particular, it can also be provided that the axial length of the tapered radially outer surface and the axial depth of the inner cavity are equal. This also contributes to uniform the heat conduction.

Particularly preferably, it is provided that in a region between the point of intersection of the inner cavity with the center axis of the melting head and the front axial melting-head edge, the surface sizes of the radially outer surface and the surface of the inner cavity are equal. This ensures that, at least substantially, the same amount of heat can be dissipated per unit of time through these respective surfaces, which in turn equalizes in particular the heat transport to the inside and outside.

Furthermore, it is particularly preferred, in particular in combination with the above-mentioned embodiment, if the surfaces of the outer surface and the inner cavity projected in the travel direction are of the same size, in particular because then, due to the propagation, an at least substantially equal application of force occurs on the inner and outer surfaces.

The invention can preferably provide for all possible embodiments that the outer surface and the inner cavity are formed to be n-fold rotation-symmetrical, preferably rotationally symmetrical, about a central axis of the melting head extending in the travel direction. With an n-fold rotational symmetry, the outer and inner cross-sections of the melting head (viewed perpendicular to the travel direction) are n-polygonal, or the respective outer and inner surfaces are faceted, and with a rotationally symmetrical design, the respective cross-section is thus circular.

A preferred, in particular rotationally symmetrical geometry of the melting head can provide that the outer surface and the surface of the inner recess correspond to a conic section or a section of a paraboloid.

The invention can further provide that the tapered front end corresponds to a rotation body, in particular a conic section or paraboloid section, which is rotationally symmetrical about the central axis and the tip region of which is folded toward the interior of the melting head at the plane in which the front axial melting-head edge lies so as to form the cavity.

Apart from the sign and an axial displacement, in particular an axial displacement of twice the axial length of the front end, the shape, in particular the cross-sectional shape viewed parallel to the central axis of the outer surface and the inner cavity, can in particular follow the same mathematical function depending on the radial spacing from the central axis.

BRIEF DESCRIPTION OF THE DRAWING

Embodiments of the invention are described in more detail with reference to the figures. Therein.

SPECIFIC DESCRIPTION OF THE INVENTION

Figures 1A, 1B, 1C, 1D:
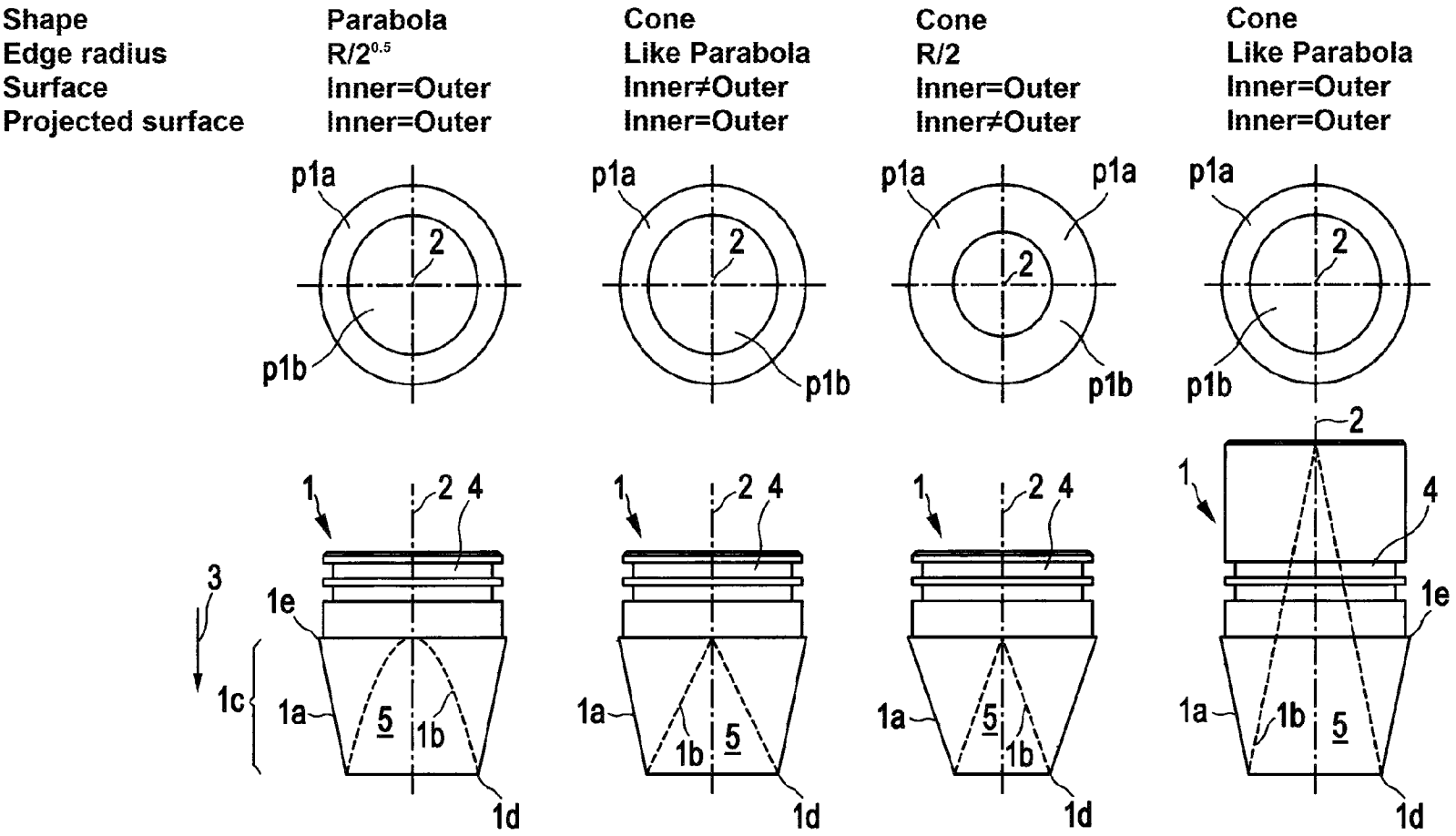
FIGS. 1A-1D show different embodiments of the invention.

FIGS. 1A to 1D show different geometries of the outer surface 1*a* and inner surface 1*b* of a melting head 1 according to the invention in cross-section, i.e. cut in a plane including the center axis 2 of the melting head 1.

The travel direction 3 is shown for all FIGS. 1[A to D] by the arrow [3] to the left of FIGS. 1[A to D].

It can be seen for all embodiments of FIGS. 1[A to D] that the front end 1*c* of the melting head 1 has the radially outer surface 1*a*. Seen in cross-section perpendicular to the center axis 2 this surface tapers in the travel direction. With the rotational symmetry present here, the outer diameter of the outer surface 1*a* thus decreases in a direction from the rear attachment end 4 to the axially front melting-head edge 1*d*.

The beginning of the taper at a collar 1*e* preferably defines here the axial beginning of the front end [1*c*], and the melting-head edge 1*d* defines the end of the front end [1*c*].

The upper views of circular areas above FIGS. 1A to 1D show the projected surfaces of the radially outer surface and the inner surface 1*b* of the cavity 5. According to the projected surfaces p1*a* and p1*b*, the embodiments represent the possibilities to make the sizes of the surfaces 1*a* and 1*b* or the sizes of the projections p1*a* and p1*b* the same or to make different sizes, in particular with the particular advantages as mentioned in the general part of the description.

FIG. 1A illustrates an embodiment in which the inner surface 1*b* and the outer surface 1*a* in the cross-section shown here are each a parabola. The two parabolas differ only in the sign and an offset along the center axis 2 and are otherwise parameterized identically. Thus, the mathematical description of the cross-sectional shape of both surfaces follows the same function depending on the radial spacing to the center axis 2, apart from the offset and an inversion. Due to the rotational symmetry, the shape in space in FIG. 1A is a paraboloid section of both surfaces. The same can apply to FIG. 1B to FIG. 1D where the function describes a straight line that, in the case of rotational symmetry, leads in space to the shape of a frustoconical section of both surfaces.

FIGS. 2[A to C] show different embodiments of the melting head 1 according to FIG. 1A, thus with respective paraboloid shapes of the inner and outer surfaces 1*b* and 1*a*.

Figure 2A:
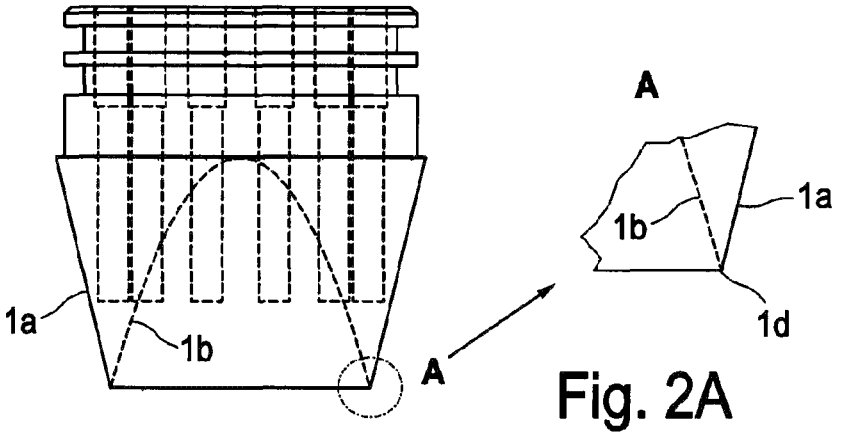
FIGS. 2A-2C are detail views of different embodiments of the invention.
Figure 2B:
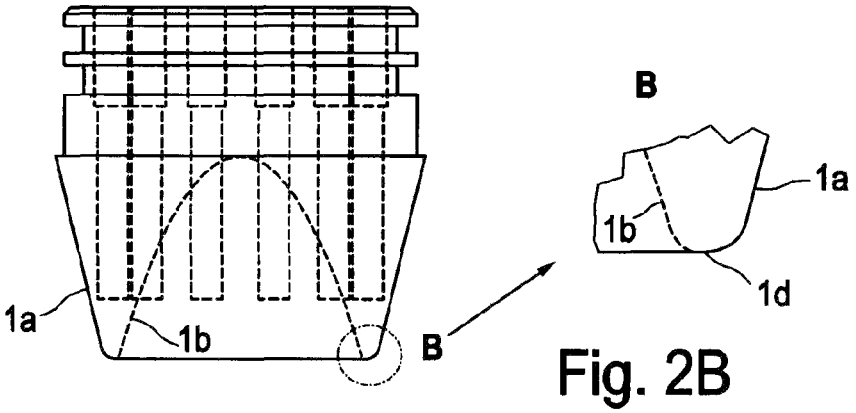
Figure 2C:
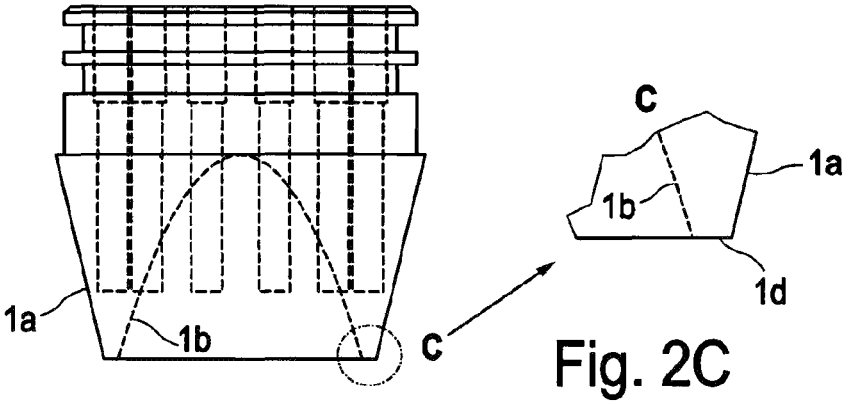

In FIG. 2A, the front axial melting-head edge 1*d* on the axial end surface form a sharp edge, and in FIG. 2B, the melting-head edge 1*d* forms a rounded or crowned shape and in FIG. 2C a flattened shape.

The figures also show holes 6 that hold respective heating elements 6'. This is also shown more clearly in FIG. 3. Here, it can be seen that the holes 6 and the respective heating elements 6' are arrayed on a circle with the radius that corresponds to the radial spacing of the melting-head edge 1*d* from the center axis 2.

As a result of this, at least the heat-emitting tips of the heating elements 6' are located, preferably centered, in an annulus 7 of the front end of the melting head, so that the heat emission thereof can take place both outward and inward over a short distance.

Figure 3:
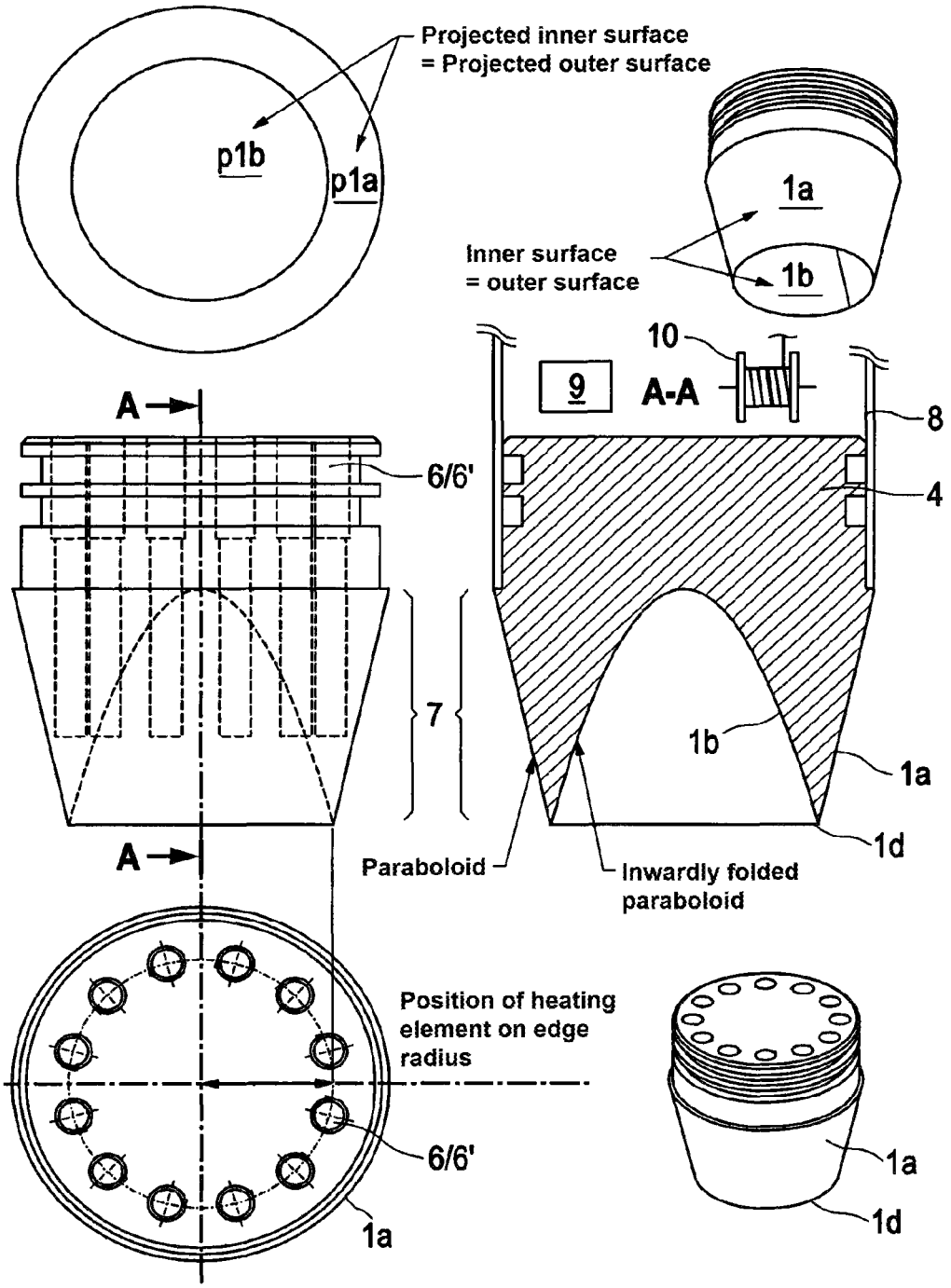
FIG. 3 is a multipart view illustrating one of the embodiments of the invention.

On the right side in FIG. 3 the rear attachment end 4 is shown extended toward the rear by a drilling string 8 with a cylindrical casing that can for example hold energy sources 9 for the heating elements 6' or other electronics 9 or cables 10 that are illustrated only symbolically here. Thus, the melting head 1 together with this drilling string 8 forms an ice-melting apparatus.

Figure 4:
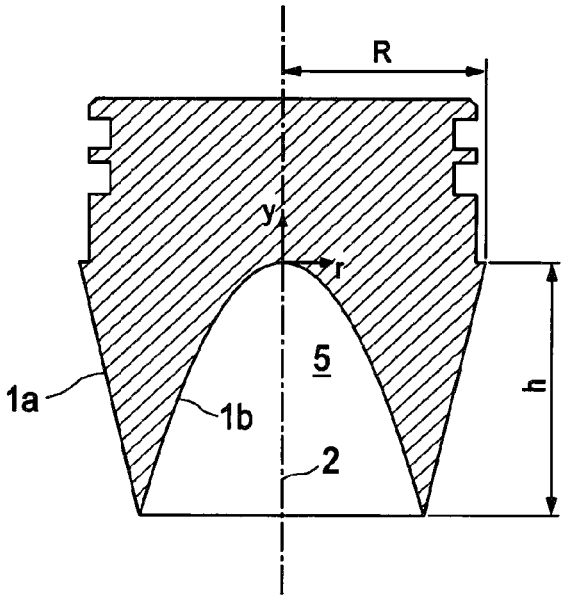
FIG. 4 is a detailed view showing dimensions and a formula relating to the illustrated dimensions.

FIG. 4 shows clearly that in the preferred embodiment both the outer surface 1*a* and the inner surface 1*b* of the cavity 5 are described by the same parabolic formula P and differ only by an inversion I and an offset O along the center axis 2.

With the parameterization shown here, the axially front ring-shaped melting-head edge is located at position $r=R/2^{-2}$. Here, the inner and outer surfaces 1*a* and 1*b* merge into each other. R is the maximum outer diameter of the melting head 1 and h is the depth of the cavity 5 or, respectively, the height of the tapered front end or annulus 7.

The invention claimed is:

1. A melting head of an ice-melting apparatus displaceable in a travel direction extending along a central axis, the melting head comprising:

a rear attachment end for attaching to a drilling string or a drill rod assembly; and a heatable front end formed with an axially forwardly open cavity, a front edge, a radially outwardly directed outer surface that decreases in diameter relative to the axis in the travel direction up to the front edge, and a radially inwardly directed inner surface that surrounds the cavity and whose free inner cross-sectional area decreases from the front edge counter to the travel direction, areas of the inner surface and the outer surface being equal to each other and areas of axial projections of the inner surface and outer surface also being equal to each other.

2. The melting head according to claim 1, wherein the front edge forms an annular border at which the radially outer surface and the inner surface of the inner cavity merge into each other and that points axially forward in the travel direction and is formed sharp-edged or crowned or flattened.

3. The melting head according to claim 1, wherein the outer surface and the inner surface of the cavity are formed to be n-fold rotation-symmetrical about the central axis extending in the travel direction.

4. The melting head according to claim 1, further comprising:

a plurality of heating elements embedded in the front end between the radially outer surface and the inner surface of the cavity.

5. The melting head according to claim 1, further comprising:

a plurality of heating elements each inserted into a respective rear hole formed in the head, the heating elements and holes each having a radial spacing from the center axis that corresponds at least substantially to a radial spacing of the front edge.

6. The melting head according to claim 1, wherein the outer surface and the inner surface each correspond to a conic section or a section of a paraboloid.

7. The melting head according to claim 1, wherein the front end is a body of revolution of frustoconical or paraboloid section that is rotationally symmetrical about the center axis and whose end region is folded inward at a plane on which the melting-head edge lies so as to form the cavity.

8. An ice-melting apparatus, comprising a melting head according to claim 1, the head being at an axial rear attachment end in the travel direction connected to a drilling string that comprises an axially extending tubularly cylindrical casing in which energy storage for the heating of heating elements of the melting head or an unwindable cable supply is contained.

9. The melting head according to claim 1, wherein the inner and outer surfaces are of the same length measured parallel to the axis.

10. The melting head according to claim 1, wherein the inner surface axially rearwardly closes the cavity.

* * * * *